US008939560B2

(12) United States Patent
Kyotani

(10) Patent No.: US 8,939,560 B2
(45) Date of Patent: Jan. 27, 2015

(54) LIQUID SUPPLYING APPARATUS AND ITS CONTROL METHOD

(71) Applicant: Tadao Kyotani, Nagoya (JP)

(72) Inventor: Tadao Kyotani, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 22 days.

(21) Appl. No.: 13/853,228

(22) Filed: Mar. 29, 2013

(65) Prior Publication Data

US 2013/0258004 A1 Oct. 3, 2013

(30) Foreign Application Priority Data

Mar. 30, 2012 (JP) ..... 2012-079747

(51) Int. Cl.
*B41J 2/175* (2006.01)
*B41J 2/17* (2006.01)
*B41J 29/393* (2006.01)

(52) U.S. Cl.
CPC ..... *B41J 2/175* (2013.01); *B41J 2/17509* (2013.01); *B41J 2/17566* (2013.01)
USPC ..... 347/85; 347/7; 347/19; 347/84

(58) Field of Classification Search
CPC .... B41J 2/17566; B41J 2/17509; B41J 2/175; B41J 2/17513; B41J 2/1752; B41J 2002/17573
USPC ..... 347/7, 19, 84, 85, 86
See application file for complete search history.

(56) References Cited

U.S. PATENT DOCUMENTS 7,992,955 B2 * 8/2011 Takata ..... 347/85
8,534,785 B2 * 9/2013 Asami ..... 347/19

FOREIGN PATENT DOCUMENTS

JP 2001-239676 A 9/2001
JP 2002-001986 A 1/2002

* cited by examiner

*Primary Examiner* — Jannelle M Lebron
(74) *Attorney, Agent, or Firm* — Scully, Scott, Murphy & Presser, PC

(57) ABSTRACT

A liquid passage communicates a first reservoir of a main tank with a second reservoir storing a liquid supplied from the first reservoir, and has one end portion on the side communicating with the first reservoir, which joins with or detach from the main tank. To increase the liquid volume in the second reservoir up to a first predetermined volume, a controller feeds the liquid in the first reservoir to the second reservoir when the liquid volume in the second reservoir is less than a second predetermined volume. When the liquid volume in the second reservoir falls short of the first predetermined volume, the end portion of the liquid passage is detached from the main tank. Then, the controller determined whether the liquid volume in the second reservoir is equal to or more than the first predetermined volume.

10 Claims, 9 Drawing Sheets

LIQUID SUPPLYING APPARATUS AND ITS CONTROL METHOD

CROSS REFERENCE TO RELATED APPLICATION

The present application claims priority from Japanese Patent Application No. 2012-79747, which was filed on Mar. 30, 2012, the disclosure of which is herein incorporated by reference in its entirety.

BACKGROUND OF THE INVENTION

1. Field of the Invention

The present invention relates to a liquid supplying apparatus used for supplying a liquid, and to a control method of the liquid supplying apparatus.

2. Description of Related Art

There has been known an inkjet recording apparatus including: a sub tank configured to temporarily store ink in an ink cartridge (main tank) before the ink is replenished to a recording head; a supplying tube (liquid passage) communicating the sub tank to the ink cartridge set to a cartridge holder (tank receiving portion); and an ink volume sensor configured to detect the ink volume in the sub tank. In this inkjet recording apparatus, when a sensor result from the ink volume sensor is such that the ink volume in the sub tank is less than a predetermined volume despite the ink supply operation from the ink cartridge to the sub tank, the ink cartridge is determined as to be in the ink-finished state (the ink cartridge does not store the ink that can be fed to the sub tank).

SUMMARY OF THE INVENTION

When an ink reservoir of the ink cartridge is one that shrinks with a decrease in the volume of the ink liquid enclosed therein, there will be remaining ink in the supplying tube, because no air enters in the supplying tube even when the ink cartridge is in the ink-finished state. If the ink cartridge is detached from the cartridge holder during this state, the air enters in the supplying tube and the remaining ink in the supplying tube flows into the sub tank. Thus, if an ink cartridge in the ink-finished state is mistakenly set to the cartridge holder at the time of replacing the ink cartridge, the ink liquid volume in the sub tank may be equal to or more than the predetermined volume, which may cause the inkjet recording apparatus to mistake that the ink cartridge set is not in the ink-finished state (i.e., a new ink cartridge is set).

In view of the above problem, an object of the present invention is to provide a liquid supplying apparatus and its control method, which enables determining of the time for replacing a main tank set to a tank receiving portion by capable accurately determining whether the main tank set stores the liquid at the time of replacing the same.

A liquid supplying apparatus related to one embodiment includes: a tank receiving portion, a sub tank, a liquid passage, a mover, a liquid feeder, a sensor, and a control unit. The tank receiving portion is configured to receive a main tank. The main tank includes a first reservoir configured to store a liquid in such a manner as to seal off the surrounding space and configured to shrink as the liquid is fed to the outside of the first reservoir. The sub tank is disposed in a position lower than a position of the tank receiving portion, and includes a second reservoir configured to store the liquid supplied from the first reservoir of the main tank set to the tank receiving portion. The liquid passage is configured to communicate the first reservoir of the main tank set to the tank receiving portion with the second reservoir, whose one end portion on the side to be in communication with the first reservoir is configured to be joined with or detached from the main tank. The mover is configured to move the tank receiving portion and the end portion of the liquid passage relatively to each other so as to join or detach the end portion of the liquid passage with or from the main tank set to the tank receiving portion. The liquid feeder is configured to feed the liquid stored in the first reservoir of the main tank set to the tank receiving portion to the second reservoir through the liquid passage. The sensor is disposed at the sub tank and is configured to output a signal related to a level of liquid in the second reservoir. The controller is configured to: (a) control the mover and the liquid feeder; (b) determine whether a liquid volume in the second reservoir is less than a second predetermined volume which is less than a first predetermined volume; (c) operate the liquid feeder so as to feed the liquid stored in the first reservoir of the main tank set to the tank receiving portion to the second reservoir, when the controller determines that the liquid volume in the second reservoir is less than the second predetermined volume, in order to increase the liquid volume in the second reservoir up to the first predetermined volume or more; (d) determine whether the liquid volume in the second reservoir is equal to or more than the first predetermined volume based on the signal of the sensor after the operation of (c); (e) operate the mover so as to detach the end portion of the liquid passage from the main tank set to the tank receiving portion when the controller determines that the liquid volume in the second reservoir is less than the first predetermined volume; and (f) determine whether the liquid volume in the second reservoir is equal to or more than the first predetermined volume based on the signal of the sensor after the operation of (e).

A liquid supplying apparatus related to another embodiment includes: a tank receiving portion, a sub tank, a liquid passage, an anti-back flow mechanism, a mover, a liquid feeder, a sensor, and a control unit. The tank receiving portion is configured to receive a main tank. The main tank includes a first reservoir configured to store a liquid in such a manner as to seal off the surrounding space and is configured to shrink as the liquid is fed to the outside of the first reservoir. The sub tank disposed in a position higher than a position of the tank receiving portion, and includes a second reservoir configured to store the liquid supplied from the first reservoir of the main tank set to the tank receiving portion. The liquid passage is configured to communicate the first reservoir of the main tank set to the tank receiving portion with the second reservoir, whose one end portion on the side to be in communication with the first reservoir is configured to be joined with or detached from the main tank. The anti-back flow mechanism is configured to prevent the liquid in the liquid passage from flowing out from the end portion of the liquid passage. The mover is configured to move the tank receiving portion and the end portion of the liquid passage relatively to each other so as to join or detach the end portion of the liquid passage with or from the main tank set to the tank receiving portion. The liquid feeder is configured to feed the liquid stored in the first reservoir of the main tank set to the tank receiving portion to the second reservoir through the liquid passage. The sensor is disposed at the sub tank and configured to output a signal related to a level of liquid in the second reservoir. The controller is configured to: (a) control the mover and the liquid feeder; (b) determine whether a liquid volume in the second reservoir is less than a second predetermined volume which is less than a first predetermined volume; (c) operate the liquid feeder so as to feed the liquid stored in the first reservoir of the main tank set to the tank receiving portion to the second reservoir, when the controller determines that the liquid volume in the second reservoir is less than the second predetermined volume, in order to increase the liquid volume in the second reservoir up to the first predetermined volume or more; (d) determine whether the liquid volume in the second reservoir is equal to or more than the first predetermined volume based on the signal of the sensor after the operation of (c); (e) operate the mover so as to detach the end portion of the liquid passage from the main tank set to the tank receiving portion when the controller determines that the liquid volume in the second reservoir is less than the first predetermined volume; (f) determine whether the liquid volume in the second reservoir is equal to or more than the first predetermined volume based on the signal of the sensor after the operation of (e); and (g) operate the liquid feeder to feed the liquid in the liquid passage to the second reservoir, in order to increase the liquid volume in the second reservoir up to the first predetermined volume or more between the operation of (e) and the determination of (f).

A method of controlling a liquid supplying apparatus related to one embodiment is for controlling a liquid supplying apparatus including a tank receiving portion, a sub tank, a liquid passage, a mover, a liquid feeder, and a sensor. The tank receiving portion is configured to receive a main tank. The main tank comprising a first reservoir configured to store a liquid in such a manner as to seal off the surrounding space and configured to shrink as the liquid is fed to the outside of the first reservoir. The sub tank is disposed in a position lower than a position of the tank receiving portion, and includes a second reservoir configured to store the liquid supplied from the first reservoir of the main tank set to the tank receiving portion. The liquid passage is configured to communicate the first reservoir of the main tank set to the tank receiving portion with the second reservoir, whose one end portion on the side to be in communication with the first reservoir is configured to be joined with or detached from the main tank. The mover is configured to move the tank receiving portion and the end portion of the liquid passage relatively to each other so as to join or detach the end portion of the liquid passage with or from the main tank set to the tank receiving portion. The liquid feeder is configured to feed the liquid stored in the first reservoir of the main tank set to the tank receiving portion to the second reservoir through the liquid passage. The sensor is disposed at the sub tank and configured to output a signal related to a level of liquid in the second reservoir. The above method includes: (a) controlling the mover and the liquid feeder; (b) determining whether a liquid volume in the second reservoir is less than a second predetermined volume which is less than a first predetermined volume; (c) operating the liquid feeder so as to feed the liquid stored in the first reservoir of the main tank set to the tank receiving portion to the second reservoir, when the controller determines that the liquid volume in the second reservoir is less than the second predetermined volume, in order to increase the liquid volume in the second reservoir up to the first predetermined volume or more; (d) determining whether the liquid volume in the second reservoir is equal to or more than the first predetermined volume based on the signal of the sensor after the operation of (c); (e) operating the mover so as to detach the end portion of the liquid passage from the main tank set to the tank receiving portion when the controller determines that the liquid volume in the second reservoir is less than the first predetermined volume; and (f) determining whether the liquid volume in the second reservoir is equal to or more than the first predetermined volume based on the signal of the sensor after the operation of (e).

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

The following describes an inkjet printer having a liquid supplying apparatus related to a first embodiment.

Figure 1:
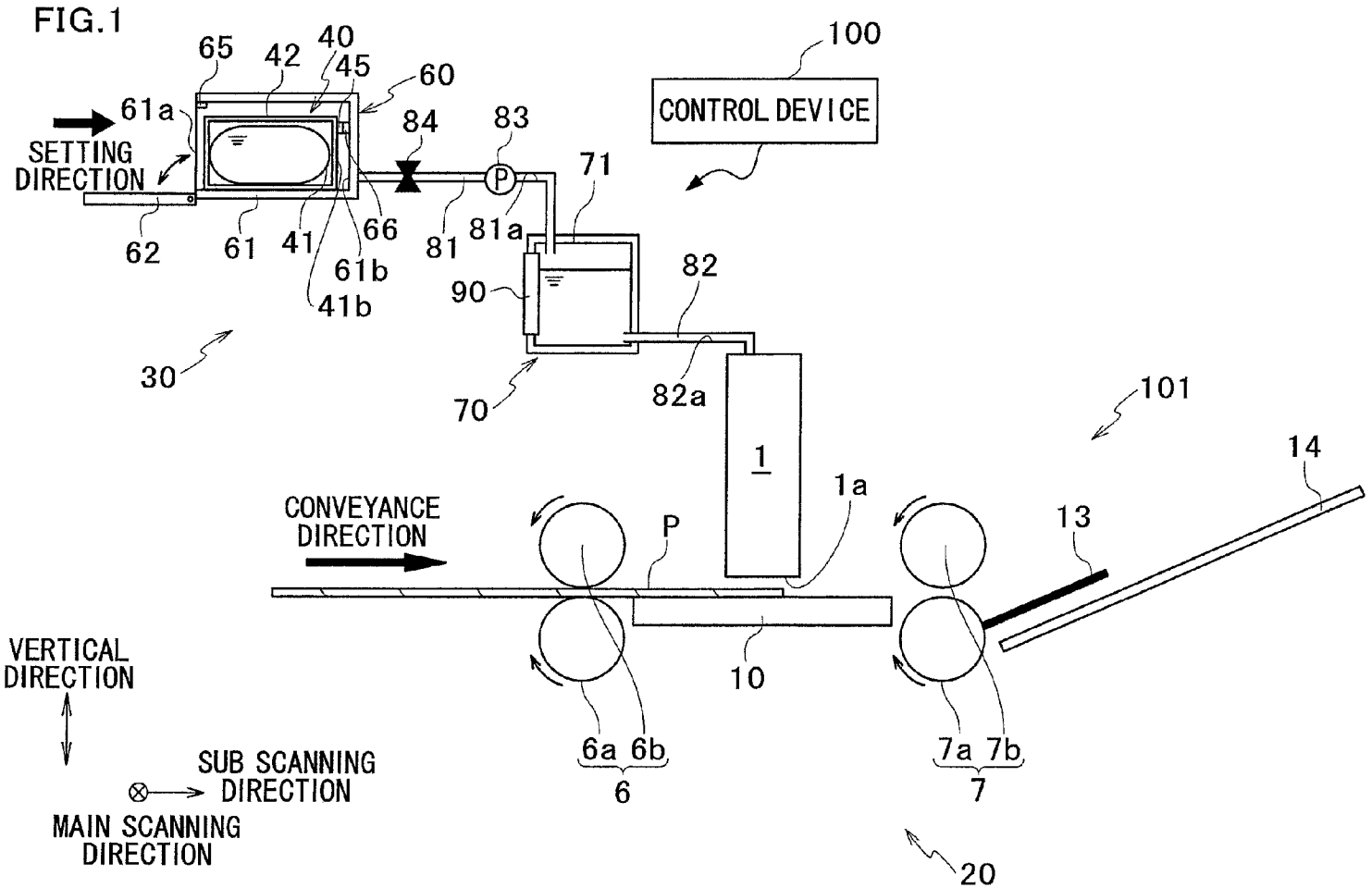
FIG. 1 is a schematic side view of an inkjet printer having a liquid supplying apparatus related to a first embodiment.

As shown in FIG. 1, an inkjet printer 101 includes: a conveyor 20 configured to convey a sheet P serving as a recording medium; an inkjet head 1 configured to eject ink to the sheet P conveyed by the conveyor 20; and a liquid supplying apparatus 30 configured to supply the ink stored in a cartridge 40 to the inkjet head 1. In the present embodiment, the cartridge 40 corresponds to the main tank.

The conveyor 20 is a mechanism to convey the sheet P in a conveyance direction, i.e., from the left to the right of FIG. 1, and includes: a first conveyance unit 6, a second conveyance unit 7, a platen 10, a separation plate 13, and a sheet receiving tray 14.

The first conveyance unit 6 has a pair of conveyance rollers 6*a* and 6*b* and a not-shown drive motor which drives and rotates the conveyance rollers 6*a* and 6*b*. The pair of conveyance rollers 6*a* and 6*b* are rotated in different directions (see the arrows in the figure) by the drive motor, respectively, and convey the sheet P supplied from a not-shown sheet supplier in the conveyance direction, while sandwiching the sheet P.

The second conveyance unit 7 has a pair of conveyance rollers 7*a* and 7*b* and a drive motor which drives and rotates the conveyance rollers 7*a* and 7*b*. The conveyance rollers 7*a* and 7*b* are rotated in different directions (see the arrows in the figure) by the drive motor, respectively, and receive and convey the sheet P conveyed by the first conveyance unit 6 in the conveyance direction, while sandwiching the sheet P.

The inkjet head 1 (hereinafter, head 1) extends in a main scanning direction, and is disposed in a position between the first conveyance unit 6 and the second conveyance unit 7, relative to the conveyance direction. The under surface of the head 1 serves as an ejection face 1*a* having ejection openings for ejecting ink. On the top surface of the head 1 is provided a not-shown joint to which a later-described second supplying tube 82 of the liquid supplying apparatus 30 is set. Inside the head 1 is formed passages through which a liquid supplied from the liquid supplying apparatus 30 reaches the ejection openings. The head 1 ejects ink droplets from the ejection opening, when the sheet P conveyed by the conveyor 20 passes immediately below the inkjet head 1. Through this, a desirable image is recorded on the sheet P.

The main scanning direction is a direction perpendicular to the conveyance direction of the sheet P shown in FIG. 1 and parallel to the horizontal plane. Further, the sub scanning direction is a direction perpendicular to the main scanning direction and parallel to the horizontal plane.

The platen 10 is positioned between the first conveyance unit 6 and the second conveyance unit 7 relative to the sheet P conveyance direction, and is disposed to face the ejection face 1*a* of the inkjet head 1. The platen 10 supports, from underneath, the sheet P conveyed by the first conveyance unit 6 and the second conveyance unit 7. At this time, a predetermined space suitable for image recording is formed between the top surface of the platen 10 and the ejection face 1*a* of the inkjet head 1.

The separation plate 13 is disposed downstream from the second conveyance unit 7 relative to the conveyance direction, and separates the sheet P from the outer circumferences of the conveyance rollers 7*a* and 7*b*. The sheet P separated by the separation plate 13 from the outer circumferences of the conveyance rollers 7*a* and 7*b* is placed on the sheet receiving tray 14.

Next, before describing the liquid supplying apparatus 30, the following describes the cartridge 40 which is detachably set to a later-described tank receiving portion 60 of the liquid supplying apparatus 30.

Figure 2:
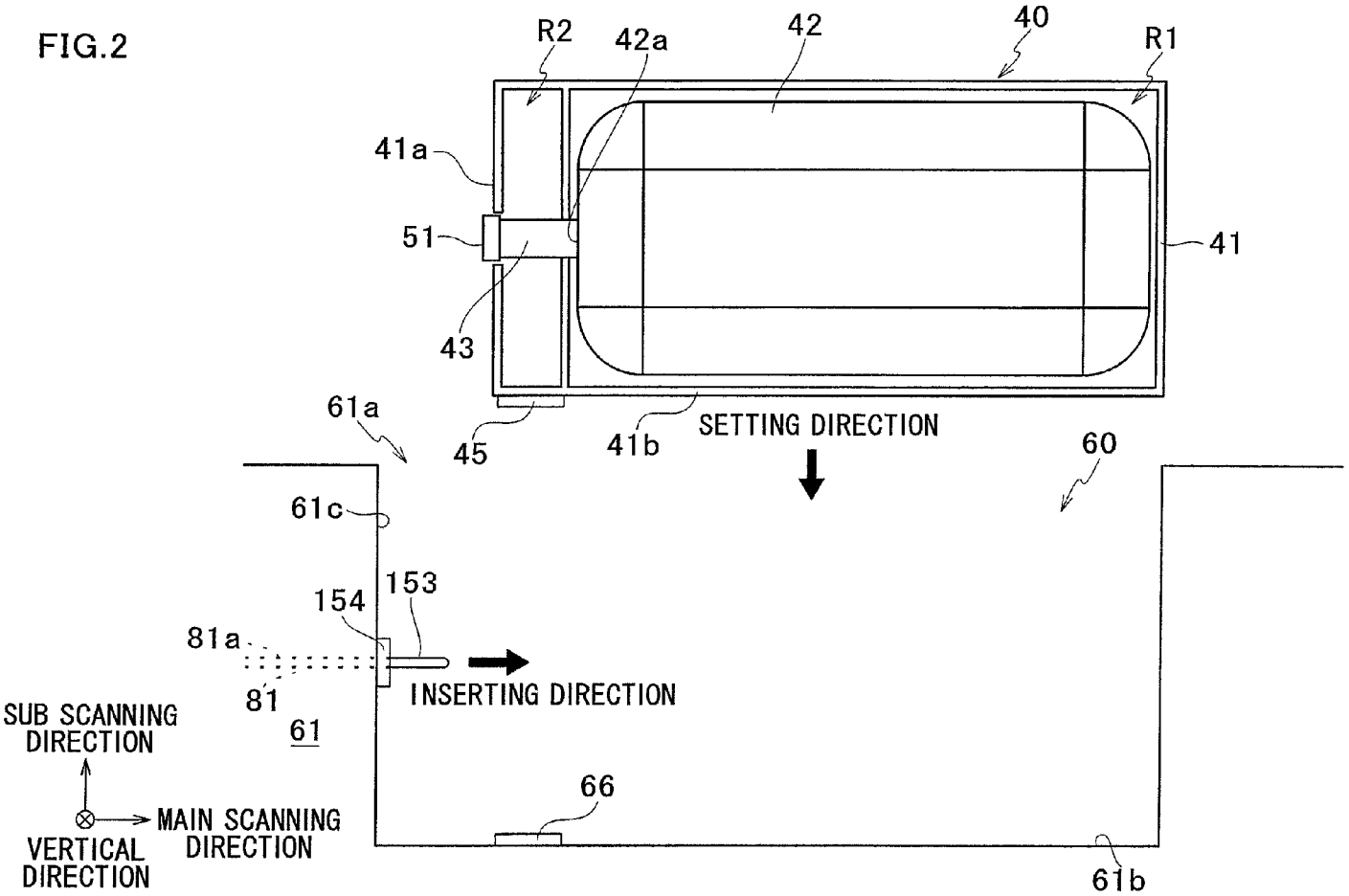
FIG. 2 is a partial cross sectional view showing a cartridge being set to a tank receiving portion.
Figure 3A:
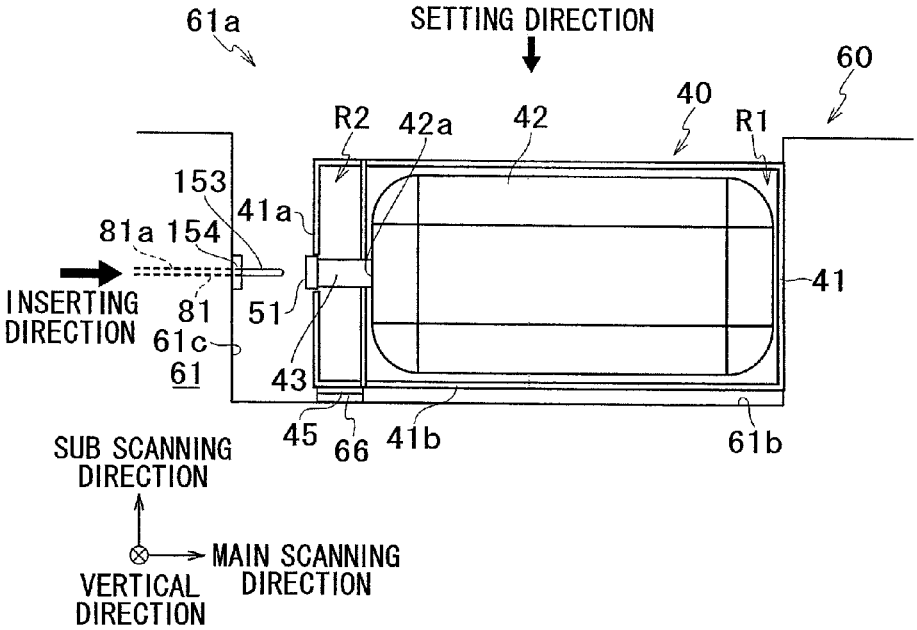
FIG. 3A is a partial cross sectional view showing the cartridge being set to the tank receiving portion.
Figure 3B:
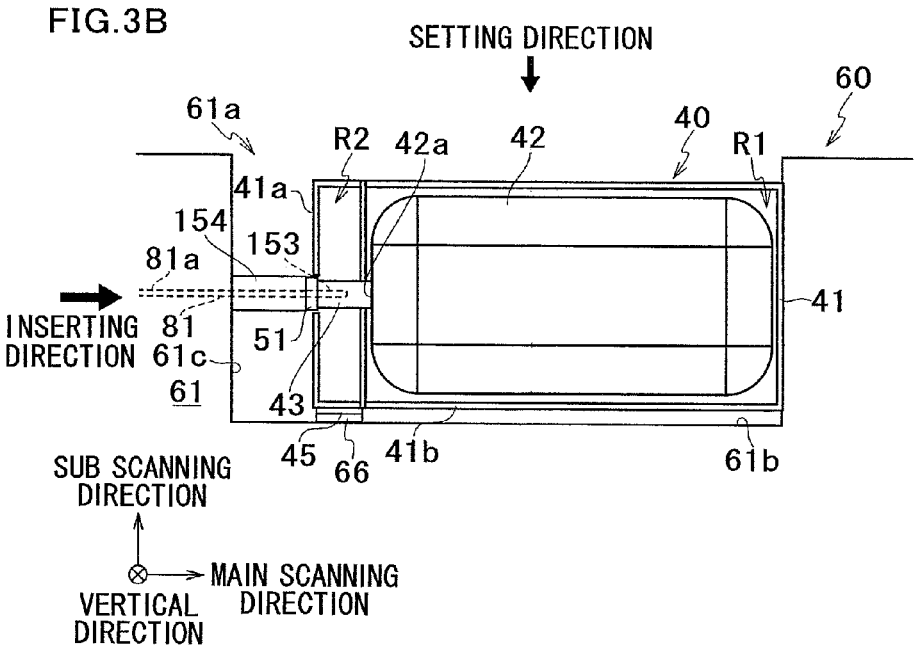
FIG. 3B is a partial cross sectional view showing the cartridge being set to the tank receiving portion.

As shown in FIG. 2, FIG. 3A, and FIG. 3B, the cartridge 40 has: a casing 41 having a substantially rectangular parallelepiped shape; an ink pouch 42 filled with ink, which is disposed in the casing 41; and an ink-leading tube 43 whose one end communicates with an ink pouch 42. In the present embodiment, the ink pouch 42 corresponds to a first reservoir.

The inside of the casing 41 is parted to form two rooms R1 and R2. In the room R1 on the right of FIG. 2 is the ink pouch 42, and in the room R2 on the left is the ink-leading tube 43. The ink pouch 42 is for storing and separating degasified ink from the surrounding space, and is made by thermal compression bonding of flexible films. This ink pouch 42 shrinks with a decrease in the volume of the ink enclosed therein. Further, as shown in FIG. 4A and FIG. 4B, a connecting portion 42*a* serving as an opening of the ink pouch 42 is connected to the ink-leading tube 43.

In the attaching posture of the cartridge 40 to the tank receiving portion 60, the ink-leading tube 43 extends in the main scanning direction (a direction which is perpendicular to the setting direction of the cartridge 40 to the tank receiving portion 60, and perpendicular to the vertical direction), and the leading end of the ink-leading tube 43 projects outwardly from the side surface 41*a* of the casing 41, as shown in FIG. 2. This ink-leading tube 43 forms a liquid passage 43*a* (see FIG. 4A and FIG. 4B) which supplies ink stored in the ink pouch 42 to the liquid supplying apparatus 30.

Figure 4A:
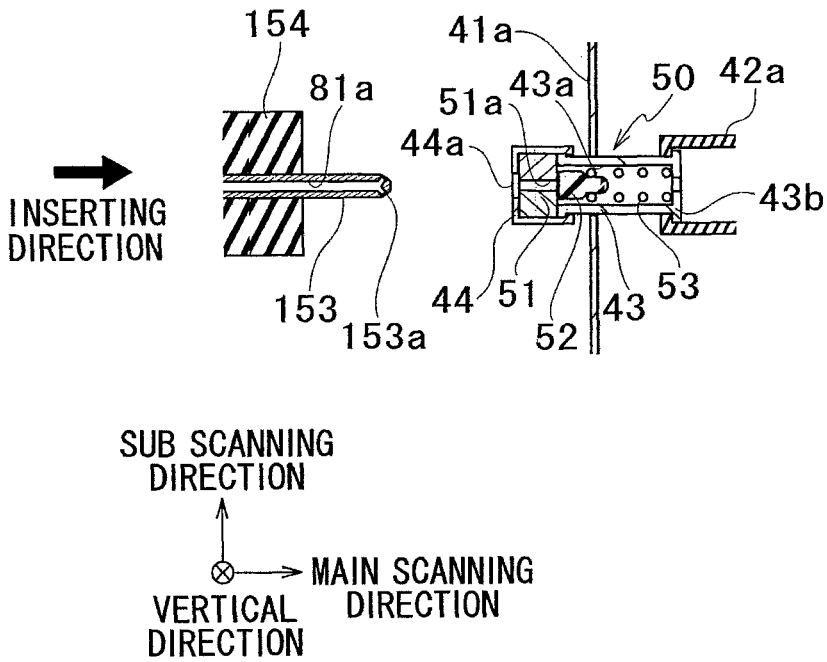
FIG. 4A is a partial cross sectional view showing a hollow needle being joined with the cartridge.
Figure 4B:
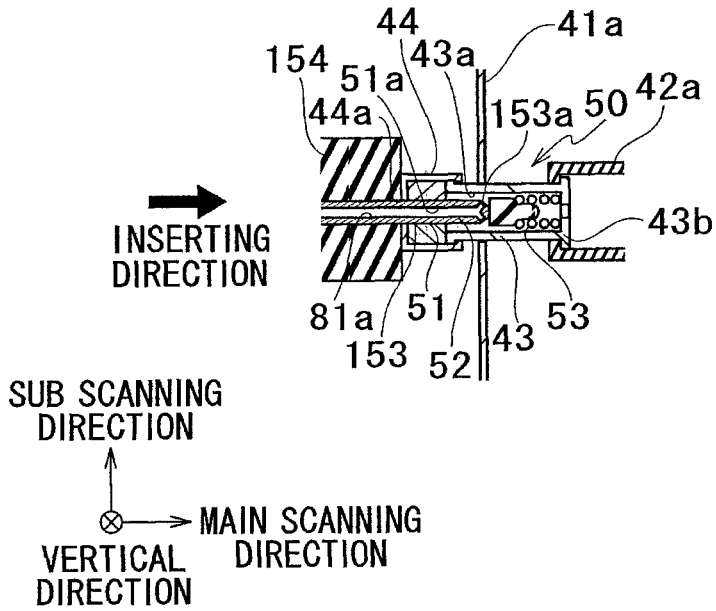
FIG. 4B is a partial cross sectional view showing the hollow needle being joined with the cartridge.

Further, as shown in FIG. 4A and FIG. 4B, the ink-leading tube 43 is provided with a valve system 50. The valve system 50 includes a plug 51, a valve element 52, and a coil spring 53. The plug 51 is provided to a leading end portion of the ink-leading tube 43, and is structured by an elastic material such as rubber. Further, the plug 51 has at its center a slit (through hole) 51*a* extending in the main scanning direction. The diameter of the slit 51*a* is smaller than that of the later-described hollow needle 153. Therefore, while the hollow needle 153 is inserted into the slit 51*a*, the plug 51 undergoes elastic deformation so that the inner circumference of the slit 51*a* is firmly attached to the outer circumference of the hollow needle 153, thus preventing leakage of ink between the hollow needle 153 and the slit 51*a*.

The valve element 52 is set to the plug 51 in the ink-leading tube 43 and is configured to abut or detach from the plug 51 by moving in the main scanning direction. An area of a cross section of the valve element 52 taken in a direction perpendicular to the main scanning direction is greater than that of the slit 51*a* but smaller than that of the ink-leading tube 43. The coil spring 53 has one end contacting the valve element 52 and another end contacting a stepped portion 43*b* formed at another end of the ink-leading tube 43, and constantly biasing the valve element 52 towards the plug 51.

Note that the leading end portion of the ink-leading tube 43 is provided with a cover 44 which prevents the plug 51 from falling off from the ink-leading tube 43. On the cover 44 is formed an ink exhaust port 44*a*.

In this structure, when the hollow needle 153 is inserted into the slit 51*a* of the plug 51 through the ink exhaust port 44*a*, the leading end of the hollow needle 153 abuts the valve element 52. This causes the valve element 52 to move in a direction towards right of FIG. 4A against the biasing force by the coil spring 53. As the result, the valve element 52 detaches from the plug 51 (see FIG. 4B). At this time, the valve system 50 in a closed state changes to an open state. While the valve system 50 is in the open state, the ink pouch 42 and the hollow needle 153 are in communication via the liquid passage 43*a*. On the other hand, when the hollow needle 153 is moved in a direction to be extracted from the slit 51*a*, the valve element 52 is moved in a direction approaching the plug 51 due to the biasing force by the coil spring 53. When the valve element 52 abuts the plug 51, the valve system 50 in the open state changes to the closed state. As described, with insertion/extraction of the hollow needle 153, the valve system 50 takes one of the following two states: the open state during which the ink pouch 42 and the hollow needle 153 are in communication with each other; and a closed state in which the ink pouch 42 and the hollow needle 153 are disconnected from each other.

On a front surface 41*b* of the casing 41 which is a surface on the downstream side relative to a direction in which the cartridge 40 is set to the tank receiving portion 60, a terminal 45 is provided which corresponds to a later-described tank bottom sensor 66 of the tank receiving portion 60, as shown in FIG. 2.

Next, the following describes a liquid supplying apparatus 30. As shown in FIG. 1, the liquid supplying apparatus 30 has the tank receiving portion 60, a sub tank 70, a first supplying tube 81, a second supplying tube 82, a pump 83, a valve 84, a liquid level detection sensor 90, a touch panel 95 (see FIG. 5), a moving mechanism 155 (see FIG. 5), and a control device 100 configured to control the overall operation of the liquid supplying apparatus 30. In the present embodiment, the pump 83, the touch panel 95, and the moving mechanism 155 correspond to a liquid feeder, a notification unit, and a mover, respectively.

The tank receiving portion 60 has a substantially rectangular recess 61 capable of accommodating the cartridge 40, and a tank cover 62. The opening 61*a* of the recess 61 serves as an insertion port to which the cartridge 40 is inserted. The recess 61 extends from the opening 61*a* to the tank receiving portion 60 in the direction in which the cartridge 40 is set, i.e., towards the downstream relative to the conveyance direction. The tank cover 62 is structured so as to open and close about a horizontal axis (fulcrum) extending at the lower end of the opening 61*a*. The tank cover 62 is opened and closed by a user. Note that, to replace the cartridge 40, the user opens the tank cover 62, detaches the cartridge 40 from the tank receiving portion 60, and then sets a new cartridge 40.

As shown in FIG. 1, a tank bottom sensor 66 is provided on a bottom wall 61*b* of the recess 61 which is a downstream side surface of the recess 61 relative to the direction in which the cartridge 40 is set to the tank receiving portion 60. The tank bottom sensor 66 is electrically connected to the terminal 45 of the cartridge 40 when the cartridge 40 is set to the recess 61. The tank bottom sensor 66, upon detecting the connection with the terminal 45, outputs a detection signal to the control device 100. Based on the presence/absence of this detection signal from the tank bottom sensor 66, the control device 100 determines whether or not the cartridge 40 is set to the tank receiving portion 60.

Further, as shown in FIG. 1, on the inside surface nearby the opening 61*a* of the recess 61 is provided a cover sensor 65 which detects shutting of the tank cover 62 and outputs a detection signal to the control device 100. Based on the presence/absence of the detection signal from the cover sensor 65, the control device 100 determines whether the tank cover 62 is in a released state or a shut state.

The sub tank 70 is disposed in a position lower than the tank receiving portion 60 relative to the vertical direction, and has a buffer chamber 71 therein. The buffer chamber 71 temporarily stores the ink supplied from the ink pouch 42 of the cartridge 40 set to the tank receiving portion 60, before the ink is supplied to the head 1. Note that, to stabilize the meniscus formed on each ejection opening of the head 1 during image recording, the sub tank 70 is disposed in such a manner that a negative pressure occurs in the passage of the head 1. In the present embodiment, the buffer chamber 71 corresponds to the second reservoir.

The liquid level detection sensor 90 is provided on a side wall of the sub tank 70, and is configured to detect the liquid level of the ink in the buffer chamber 71. The control device 100 receives a detection signal related to the liquid level from the liquid level detection sensor 90, and determines the volume of ink stored in the buffer chamber 71 based on the detection signal.

One end of the first supplying tube 81 is the hollow needle 153, and the other end is connected to the buffer chamber 71 of the sub tank 70. Inside the first supplying tube 81 is formed a liquid passage 81*a* which is in communication with the buffer chamber 71.

As shown in FIG. 2, the hollow needle 153 is supported by a supporting medium 154. Supposing that the cartridge 40 is set, the hollow needle 153 and the supporting medium 154 are provided in a position of the side wall 61*b* of the recess 61 facing the side surface 41*a* of the cartridge 40 and facing the slit 51*a* of the plug 51.

The hollow needle 153 extends in the main scanning direction, and a portion of the hollow needle 153 nearby its leading end has a hole 153*a* which communicates the outside with the liquid passage 81*a* (see FIG. 4A and FIG. 4B).

The moving mechanism 155, under control of the control device 100, is capable of moving the supporting medium 154 in an inserting direction (a direction which is perpendicular to the direction in which the cartridge 40 is set to the tank receiving portion 60, and which is perpendicular to the vertical direction) and a direction opposite to the inserting direction, with respect to the tank receiving portion 60. With the movement of the supporting medium 154, the hollow needle 153 is selectively positioned in a joining position (see FIG. 3B and FIG. 4B) at which the hollow needle 153 is inserted into the plug 51 and joined with the cartridge 40, or a detaching position (see FIG. 3A and FIG. 4A) at which the hollow needle 153 is extracted from the plug 51 and detached from the cartridge 40. In short, the hollow needle 153 is capable of being joined with or detached from the cartridge 40. When the hollow needle 153 is in the joining position, the hole 153*a* passes the slit 51*a* and communicates the hollow needle 153 with the ink passage 43*a* of the ink-leading tube 43. As a result, the ink pouch 42 of the cartridge 40 and the buffer chamber 71 of the sub tank 70 are brought in communication with each other. On the other hand, when the hollow needle 153 is disposed in the detaching position, the hollow needle 153 and the ink passage 43*a* of the ink-leading tube 43 are disconnected from each other. This disconnects the ink pouch 42 of the cartridge 40 from the buffer chamber 71 of the sub tank 70. Further, since the hole 153*a* of the hollow needle 153 is exposed to the external air at this time, the air is introduced into the first supplying tube 81.

The second supplying tube 82 has one end connected to the buffer chamber 71 of the sub tank 70 and another end connected to the joint of the head 1. Inside the second supplying tube 82 is formed a liquid passage 82*a* communicating the buffer chamber 71 and the head 1.

The pump 83 and the valve 84 are provided to the first supplying tube 81, as shown in FIG. 1. The pump 83 and the valve 84 are controlled by the control device 100. When the pump 83 is driven while the cartridge 40 is set and while the valve 84 is opened, the ink stored in the ink pouch 42 of the cartridge 40 is supplied to the buffer chamber 71 of the sub tank 70 via the first supplying tube 81 (liquid passage 81*a*). As hereinabove mentioned, since a negative pressure occurs in the passage of the head 1, the ink stored in the buffer chamber 71 is automatically supplied to the head 1 via the second supplying tube 82 (liquid passage 82*a*). As a modification, a pump may be provided to the second supplying tube 82 so that the ink stored in the buffer chamber 71 is supplied to the head 1 by driving this pump.

The touch panel 95 enables various operation input by the user. The touch panel 95 is also capable of displaying various setting screens and operation status to the user.

Figure 5:
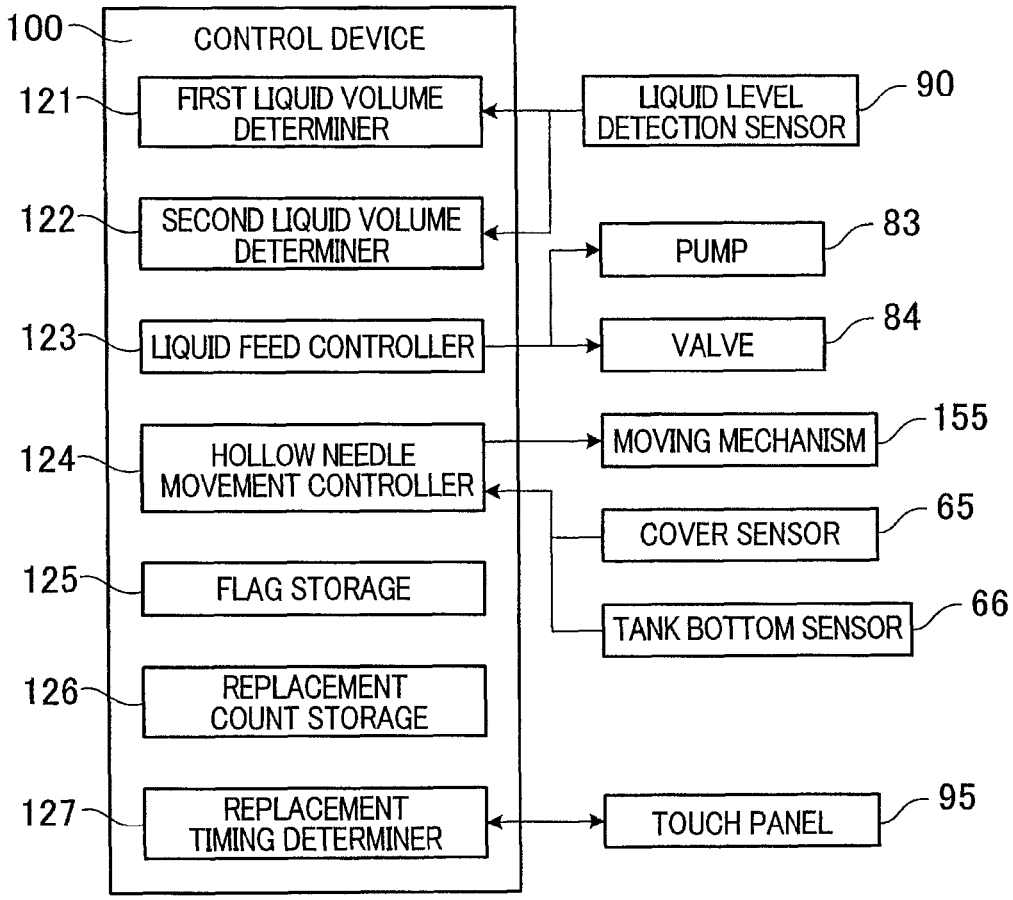
FIG. 5 is a functional block diagram of the liquid supplying apparatus shown in FIG. 1.

Next, with reference to FIG. 5, the following describes the control device 100. The control device 100 includes: a CPU (Central Processing Unit), a ROM (Read Only Memory) configured to store programs run by the CPU and data used in the programs in a rewritable manner, a RAM (Random Access Memory) configured to temporarily store data when running the programs, and a non-volatile memory. The hardware and the software in the ROM in combination structure the functional parts of the control device 100. As shown in FIG. 5, the control device 100 has a first liquid volume determiner 121, a second liquid volume determiner 122, a liquid feed controller 123, a hollow needle movement controller 124, a replacement count storage 125, a flag storage 126, and a replacement timing determiner 127. In the present embodiment, the control device 100 corresponds to the controller.

The first liquid volume determiner 121 determines whether the ink volume in the buffer chamber 71 of the sub tank 70 is equal to or more than a first predetermined volume, based on the detection signal from the liquid level detection sensor 90. The first predetermined volume is a target volume of ink which should be achieved in the buffer chamber 71 through a later-described ink feeding operation by the liquid feed controller 123.

The second liquid volume determiner 122 determines whether the ink volume in the buffer chamber 71 of the sub tank 70 is less than a second predetermined volume, based on the detection signal from the liquid level detection sensor 90. The second predetermined volume is a volume less than the first predetermined volume. When the ink volume in the buffer chamber 71 is less than the second predetermined volume, the later-described ink feeding operation by the liquid feed controller 123 is started.

When the second liquid volume determiner 122 determines that the ink volume in the buffer chamber 71 is less than the second predetermined volume, the liquid feed controller 123 controls the pump 83 and the valve 84 so that the ink stored in the ink pouch 42 of the cartridge 40 is fed to the buffer chamber 71 of the sub tank 70.

As the ink feeding operation performed by the liquid feed controller 123, there are an ordinary feeding operation and a post-insertion/extraction feeding operation. The ordinary feeding operation is an operation performed in cases where the hollow needle 153 is not inserted into or extracted from the plug 51 (i.e. the hollow needle 153 has been inserted) after the previous feeding operation. In this ordinary feeding operation, the liquid feed controller 123 opens the valve 84 and drives the pump 83 for an ordinary feeding period so that the ink volume in the buffer chamber 71 increases up to the first predetermined volume or more. After the pump 83 is stopped, the valve 84 is closed.

The post-insertion/extraction feeding operation on the other hand is an operation performed when the hollow needle 153 has been inserted into or extracted from the plug 51 after the previous feeding operation. When the hollow needle 153 is inserted into or extracted from the plug 51, the air is introduced into the liquid passage 81*a* of the first supplying tube 81. This may cause the ink in the liquid passage 81*a* to flow into the sub tank 70. Therefore, at the beginning of the post-insertion/extraction feeding operation, the ink volume in the liquid passage 81*a* may be less than the ink volume at the beginning of the ordinary feeding operation start. Since the ink volume in the liquid passage 81*a* is reduced after the hollow needle 153 is inserted into or extracted from the plug 51, the ink volume in the buffer chamber 71 may not be brought up to the first predetermined volume or more, even if the pump 83 is driven for the ordinary feeding period while the ink is stored in the ink pouch 42 of the cartridge 40. In view of this, in the post-insertion/extraction feeding operation, the liquid feed controller 123 opens the valve 84 and drives the pump 83 for a post-insertion/extraction feeding period which is longer than the ordinary feeding period so that the ink volume in the buffer chamber 71 increases up to the first predetermined volume or more. After the pump 83 is stopped, the valve 84 is closed. This way, even if the ink volume in the liquid passage 81*a* is reduced, the ink volume in the buffer chamber 71 is reliably increased up to the first predetermined volume or more.

The hollow needle movement controller 124 operates the moving mechanism 155 so that the hollow needle 153 is selectively disposed in the joining position (see FIG. 3B and FIG. 4B) or the detaching position (see FIG. 3A and FIG. 4A). Specifically, the hollow needle movement controller 124 operates the moving mechanism 155 so as to move the hollow needle 153 from the joining position to the detaching position, when determining that the state of the tank cover 62 is changed from the shut state to the released state while the cartridge 40 is set to the tank receiving portion 60, based on the detection signals from the tank bottom sensor 66 and the cover sensor 65. On the other hand, the hollow needle movement controller 124 operates the moving mechanism 155 so as to move the hollow needle 153 from the detaching position to the joining position, when determining that the state of the tank cover 62 is changed from the released state to the shut state while the cartridge 40 is set to the tank receiving portion 60, based on the detection signals from the tank bottom sensor 66 and the cover sensor 65.

In the replacement count storage 125 is stored the number of times the cartridge 40 has been replaced (hereinafter, replacement count). The replacement count stored in the replacement count storage 125 is, for example, displayed on the touch panel 95 based on an operation input by the user via the touch panel 95. In the present embodiment, the replacement count storage 125 corresponds to the storage.

The flag storage 126 stores an ink-finish flag, a replacement flag, and an insertion/extraction flag. The ink-finish flag is a flag indicating whether or not the ink pouch 42 of the cartridge 40 set to the tank receiving portion 60 stores the ink feedable to the buffer chamber 71 of the sub tank 70 (whether or not the ink-finished state has occurred). This ink-finish flag in the on-state indicates that the ink feedable to the buffer chamber 71 is not stored. The ink-finish flag in the off-state indicates that the feedable ink is stored. Further, the replacement flag is a flag indicating whether or not the replacement timing determiner 127 determines a replacement time of the cartridge 40 has come. The replacement flag in the on-state indicates that the replacement timing determiner 127 determines that the replacement time has come, and the replacement flag in the off-state indicates that the replacement time has not yet come. The insertion/extraction flag is a flag indicating whether or not the hollow needle 153 has been inserted into/extracted from the plug 51 after the previous feeding operation by the liquid feed controller 123. This insertion/extraction flag in the on-state indicates that there has been insertion/extraction of the hollow needle 153 into/from the plug 51, and the insertion/extraction flag in the off-state indicates that there has been no insertion/extraction of the hollow needle 153.

The replacement timing determiner 127 determines the replacement time of the cartridge 40 set to the tank receiving portion 60. Supposing that the replacement time of the cartridge 40 is a time when the ink pouch 42 of the cartridge 40 runs out of the feedable ink (ink-finished state), the following problem rises. Namely, the ink pouch 42 of the cartridge 40 shrinks with a decrease in the volume of ink enclosed as is already mentioned above. Thus, even if the ink pouch 42 does not store the ink feedable to the buffer chamber 71 of the sub tank 70 (ink-finished state), the ink may remain in the liquid passage 81*a* because no air is introduced in the liquid passage 81*a* of the first supplying tube 81. Detaching the cartridge 40 from the tank receiving portion 60 during this state will introduce the air into the liquid passage 81*a* with a negative pressure. Opening the valve 84 thereafter may cause the ink in the liquid passage 81*a* to flow into the buffer chamber 71. Therefore, even if a cartridge 40 in the ink-finished state is mistakenly set to the tank receiving portion 60 at the time of replacing the cartridge 40, the ink volume in the sub tank 70 may become the first predetermined volume or more. This may cause the liquid supplying apparatus 30 to mistakenly determine that the cartridge 40 set is not in the ink-finished state (the cartridge 40 set is a new ink cartridge is set). Further, when the valve 84 is not one that blocks the passage, detaching the cartridge 40 may introduce the air into the liquid passage 81*a* with the negative pressure, and the ink in the liquid passage 81*a* may flow into the buffer chamber 71, even if the valve 84 is closed. In the description below, the valve 84 is assumed to be a passage blocking valve such as a stop valve.

In view of the above problem, the replacement timing determiner 127 of the present embodiment determines the replacement time of the cartridge 40 as follows. First, when the first liquid volume determiner 121 determines that the ink volume in the buffer chamber 71 is less than the first predetermined volume despite the ink feeding operation performed by the liquid feed controller 123, the replacement timing determiner 127 causes the hollow needle movement controller 124 to operate the moving mechanism 155 so as to move the hollow needle 153 to the detaching position, thus opening the valve 84. This introduces the air into the liquid passage 81*a* of the first supplying tube 81. The ink in the liquid passage 81*a* then flows into the buffer chamber 71 of the sub tank 70, due to the weight of the ink itself. The replacement timing determiner 127 determines that the replacement time of the cartridge 40 has come, if the first liquid volume determiner 121 determines that the ink volume in the buffer chamber 71 is less than the first predetermined volume, after a predetermined period elapses from the start of this movement by the moving mechanism 155. On the other hand, when the first liquid volume determiner 121 determines that the ink volume is equal to or more than the first predetermined volume, the replacement timing determiner 127 determines that the replacement time of the cartridge 40 has not yet come. This way, when it is determined that the replacement time of the cartridge 40 has come, the liquid passage 81*a* has no ink to flow into the buffer chamber 71 of the sub tank 70 when the cartridge 40 is detached. This enables accurate determine if there is the ink in the cartridge 40 set, at the time of replacing the cartridge 40.

Further, the replacement timing determiner 127, when determining that the replacement time of the cartridge 40 has come, displays on the touch panel 95 a screen indicating, to the user, that the replacement time of the cartridge 40 has come. This way, the user is able to visibly confirm the replacement time of the cartridge 40.

Further, if the first liquid volume determiner 121 determines that the ink volume in the buffer chamber 71 is equal to or more than the first predetermined volume, after the replacement timing determiner 127 determines that the replacement time of the cartridge 40 has come, the cartridge replacement count stored in the replacement count storage 125 is counted up by 1.

Figure 6:
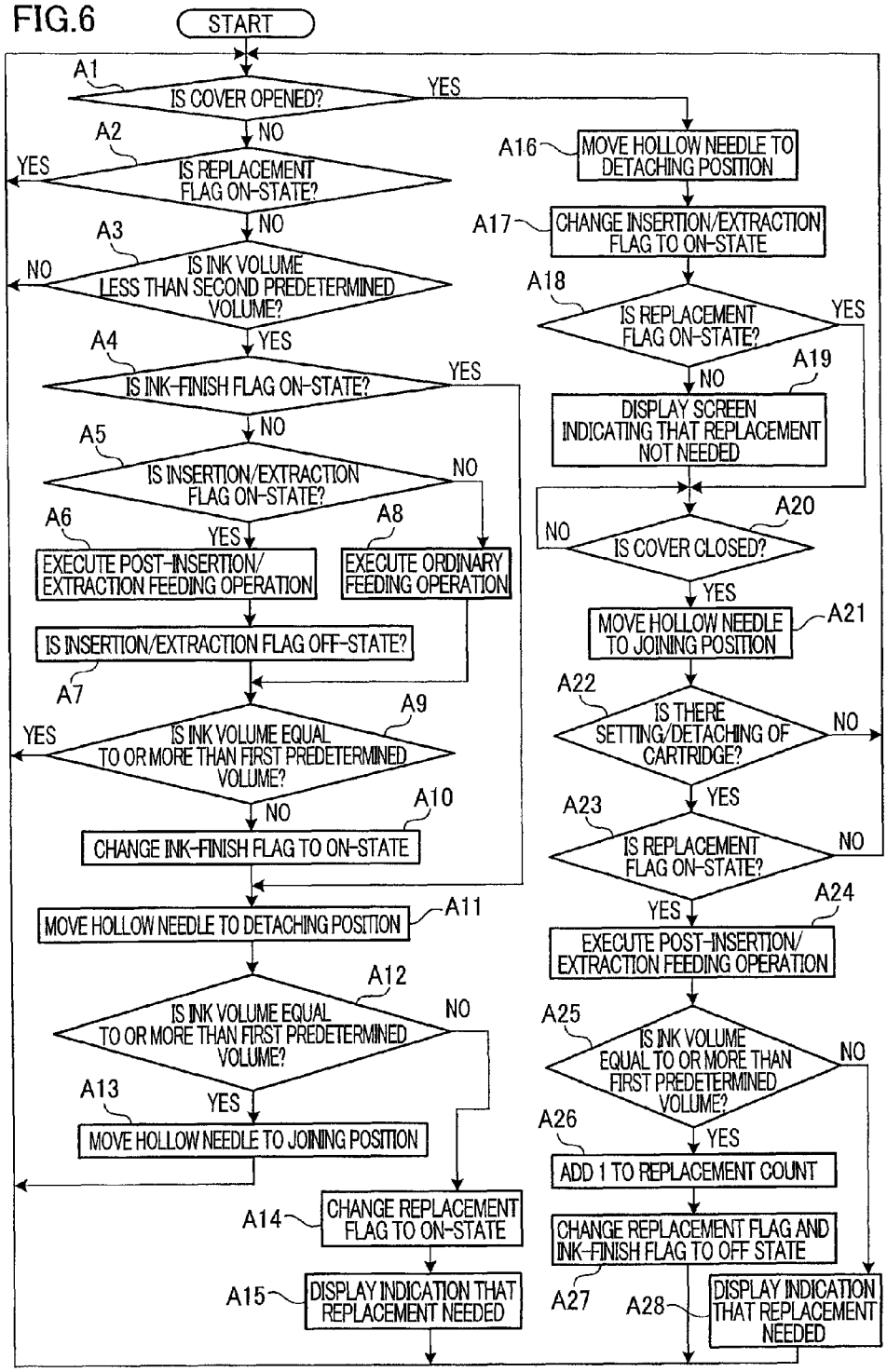
FIG. 6 is an operation flowchart of a control device of the liquid supplying apparatus shown in FIG. 1.

Next, the following describes an example operation of the liquid supplying apparatus 30, with reference to FIG. 6. At the start of the flow in FIG. 6, the cartridge 40 is set to the tank receiving portion 60. The hollow needle 153 is disposed in the joining position and is joined with the cartridge 40. The tank cover 62 is closed.

As shown in FIG. 6, the hollow needle movement controller 124 determines whether the tank cover 62 is released by the user based on the detection signal from the cover sensor 65 (A1). When the hollow needle movement controller 124 determines that the tank cover 62 is not released (A1: NO), the replacement timing determiner 127 determines whether the replacement flag in the flag storage 126 is in the on-state (A2). When the replacement timing determiner 127 determines that the replacement flag is in the on-state (A2: YES), the process returns to A1, and waits for replacement of the cartridge 40 by the user. On the other hand, when the replacement timing determiner 127 determines that the replacement flag is not in the on-state (A2: NO), the liquid feed controller 123 determines whether the second liquid volume determiner 122 determines that the ink volume in the buffer chamber 71 is less than the second predetermined volume (A3). When the second liquid volume determiner 122 does not determine that the ink volume is less than the second predetermined volume (A3: NO), the process returns to A1. On the other hand, when the second liquid volume determiner 122 determines that the ink volume is less than the second predetermined volume (A3: YES), the replacement timing determiner 127 determines whether the ink-finish flag in the flag storage 126 is in the on-state (A4). When the replacement timing determiner 127 determines that the ink-finish flag is in the on-state (A4: YES), it is determined that the ink feedable to the buffer chamber 71 of the sub tank 70 is not stored in the ink pouch 42 of the cartridge 40 (i.e., ink-finished state), and the process goes to A11.

When the replacement timing determiner 127 determines that the ink-finish flag is not in the on-state (A4: NO), the liquid feed controller 123 determines whether or not the insertion/extraction flag in the flag storage 126 is in the on-state (A5). When the liquid feed controller 123 determines that the insertion/extraction flag is in the on-state (A5: YES), the liquid feed controller 123 controls the valve 84 and the pump 83 to perform the post-insertion/extraction feeding operation, assuming that the air is introduced to the liquid passage 81*a* of the first supplying tube 81 and that not much ink remains in the liquid passage 81*a* (A6). This way, the ink is fed from the ink pouch 42 of the cartridge 40 to the buffer chamber 71. Then, the liquid feed controller 123 switches the insertion/extraction flag in the flag storage 126 to the off-state (A7). The process moves to A9 thereafter. On the other hand, when the liquid feed controller 123 determines in A5 that the insertion/extraction flag is not in the on-state (A5: NO), the liquid feed controller 123 controls the valve 84 and the pump 83 so as to perform the ordinary feeding operation, assuming that no air has been introduced into the liquid passage 81*a* (A8). This way, the ink is fed from the ink pouch 42 of the cartridge 40 to the buffer chamber 71. After A8, the process moves to A9.

In A9, the replacement timing determiner 127 determines whether or not the first liquid volume determiner 121 determines that the ink volume in the buffer chamber 71 is equal to or more than the first predetermined volume. When the first liquid volume determiner 121 determines that the ink volume is equal to or more than the first predetermined volume (A9: YES), the process returns to A1. On the other hand, when the first liquid volume determiner 121 determines that the ink volume is less than the first predetermined (A9: NO), the replacement timing determiner 127 switches the ink-finish flag in the flag storage 126 to the on-state, assuming that the ink feedable to the buffer chamber 71 of the sub tank 70 is not stored in the ink pouch 42 of the cartridge 40 (i.e., ink-finished state)(A10). The process moves to A11 thereafter.

In A11, the replacement timing determiner 127 causes the liquid feed controller 123 to open the valve 84, and causes the hollow needle movement controller 124 to operate the moving mechanism 155 so that the hollow needle 153 moves from the joining position to the detaching position. This introduces the air into the liquid passage 81*a*, and causes the ink remaining in the liquid passage 81*a* to flow into the sub tank 70.

Next, after a predetermined period elapses from the start of the operation of the moving mechanism 155 in A11, the replacement timing determiner 127 determines whether the first liquid volume determiner 121 determines that the ink volume in the buffer chamber 71 is equal to or more than the first predetermined volume (A12). When the first liquid volume determiner 121 determines that the first liquid volume determiner 121 is equal to or more than the first predetermined volume (A12: YES), the replacement timing determiner 127 determines that the replacement time of the cartridge 40 has not yet come. Then, the valve 84 is closed through the liquid feed controller 123, and the moving mechanism 155 is operated through the hollow needle movement controller 124 so that the hollow needle 153 moves from the detaching position to the joining position (A13). After A13 is ended, the process returns to A1.

On the other hand, when it is determined in A12 that the first liquid volume determiner 121 is less than the first predetermined volume (A12: NO), the replacement timing determiner 127 determines that the replacement time of the cartridge 40 has come. Then, the replacement timing determiner 127 causes the liquid feed controller 123 to closes the valve 84, and changes the replacement flag in the flag storage 126 to the on-state (A14). Next, the replacement timing determiner 127 displays a screen indicating that the replacement time of the cartridge 40 has come on the touch panel 95 (A15), and then the process returns to A1. This way the user is able to visibly confirm that the replacement time of the cartridge 40 has come.

In A1, when the hollow needle movement controller 124 determines that the tank cover 62 is released by the user (A1: YES), the hollow needle movement controller 124 operates the moving mechanism 155 so that the hollow needle 153 moves from the joining position to the detaching position (A16). Note that A16 is not executed if the hollow needle 153 is disposed in the detaching position before A16. Next, the hollow needle movement controller 124 switches the insertion/extraction flag in the flag storage 126 to the on-state (A17). Then, the replacement timing determiner 127 determines whether or not the replacement flag in the flag storage 126 is in the on-state (A18). When the replacement flag is determined as to be in the on-state (A18: YES), the process moves to A20. On the other hand, when the replacement flag is determined as not to be in the on-state (A18: NO), the replacement timing determiner 127 displays on the touch panel 95 a screen indicating that the replacement time of the cartridge 40 has not yet come (A19). This prevents the user from mistakenly replacing the cartridge 40, although the replacement time of the cartridge 40 has not yet come. After A19, the process moves to A20.

In A20, the hollow needle movement controller 124 determines whether or not the tank cover 62 is shut with the cartridge 40 being set to the tank receiving portion 60, based on the detection signals from the tank bottom sensor 66 and the cover sensor 65. When hollow needle movement controller 124 determines that the tank cover 62 is shut without the cartridge 40 being set to the tank receiving portion 60 (A20: NO), A20 is repeated. On the other hand, when it is determined that the tank cover 62 is shut with the cartridge 40 being set to the tank receiving portion 60 (A20: YES), the hollow needle movement controller 124 operates the moving mechanism 155 so that the hollow needle 153 moves from the detaching position to the joining position (A21).

Next, based on the detection signal from the tank bottom sensor 66, the replacement timing determiner 127 determines if there was setting/detaching of the cartridge 40 to/from the tank receiving portion 60 by the user between the end of the A16 and A20 (A22). When the replacement timing determiner 127 determines that there was no attaching/detaching of the cartridge 40 (A22: NO), the process returns to A1. On the other hand, when the replacement timing determiner 127 determines that there was attaching/detaching of the cartridge 40 (A22: YES), the replacement timing determiner 127 determines whether the replacement flag in the flag storage 126 is in the on-state (A23). When the replacement timing determiner 127 determines that the replacement flag is not in the on-state (A23: NO), the process returns to A1 assuming that the attachment/detachment of the cartridge 40 performed by the user is not for replacement of the cartridge 40.

On the other hand, when the replacement timing determiner 127 determines that the replacement flag is in the on-state (A23: YES), the liquid feed controller 123 controls the valve 84 and the pump 83 so as to execute the post-insertion/extraction feeding operation (A24). Next, the replacement timing determiner 127 determines whether or not the first liquid volume determiner 121 determines that the ink volume in the buffer chamber 71 is equal to or more than the first predetermined volume (A25). When the first liquid volume determiner 121 determines that the ink volume in the buffer chamber 71 is equal to or more than the first predetermined volume (A25: YES), the replacement timing determiner 127 adds 1 to the replacement count in the replacement count storage 125 (A26), and switches the replacement flag and the ink-finish flag in the flag storage 126 to the off-state (A27), assuming that a new cartridge 40 has been set to the tank receiving portion 60. The process returns to A1.

On the other hand in A25, when the first liquid volume determiner 121 determines that the ink volume is less than the first predetermined volume (A25: NO), the replacement timing determiner 127 displays on the touch panel 95 a screen indicating that the replacement time of the cartridge 40 has come (A28), assuming that the user has mistakenly set the cartridge 40 in the ink-finished state to the tank receiving portion 60. The process then returns to A1. Thus, the operation of the liquid supplying apparatus 30 is described hereinabove.

With the above-described present embodiment, the air is introduced into the liquid passage 81*a* if the ink volume in the buffer chamber 71 falls short of the first predetermined volume even after the feeding control performed by the liquid feed controller 123. This causes the ink in the liquid passage 81*a* to flow into the buffer chamber 71 due to its own weight. If the liquid volume in the buffer chamber 71 is still less than the first predetermined volume even after the ink in the liquid passage 81*a* flows into the buffer chamber 71, it is determined that the replacement time of the cartridge 40 has come. This prevents the liquid in the liquid passage 81*a* from flowing into the buffer chamber 71 of the sub tank 70 when the cartridge 40 is detached at the time of replacing the cartridge 40. Therefore, it is possible to accurately determine whether the cartridge 40 set stores the ink, when the cartridge 40 is replaced.

Second Embodiment

Figure 7:
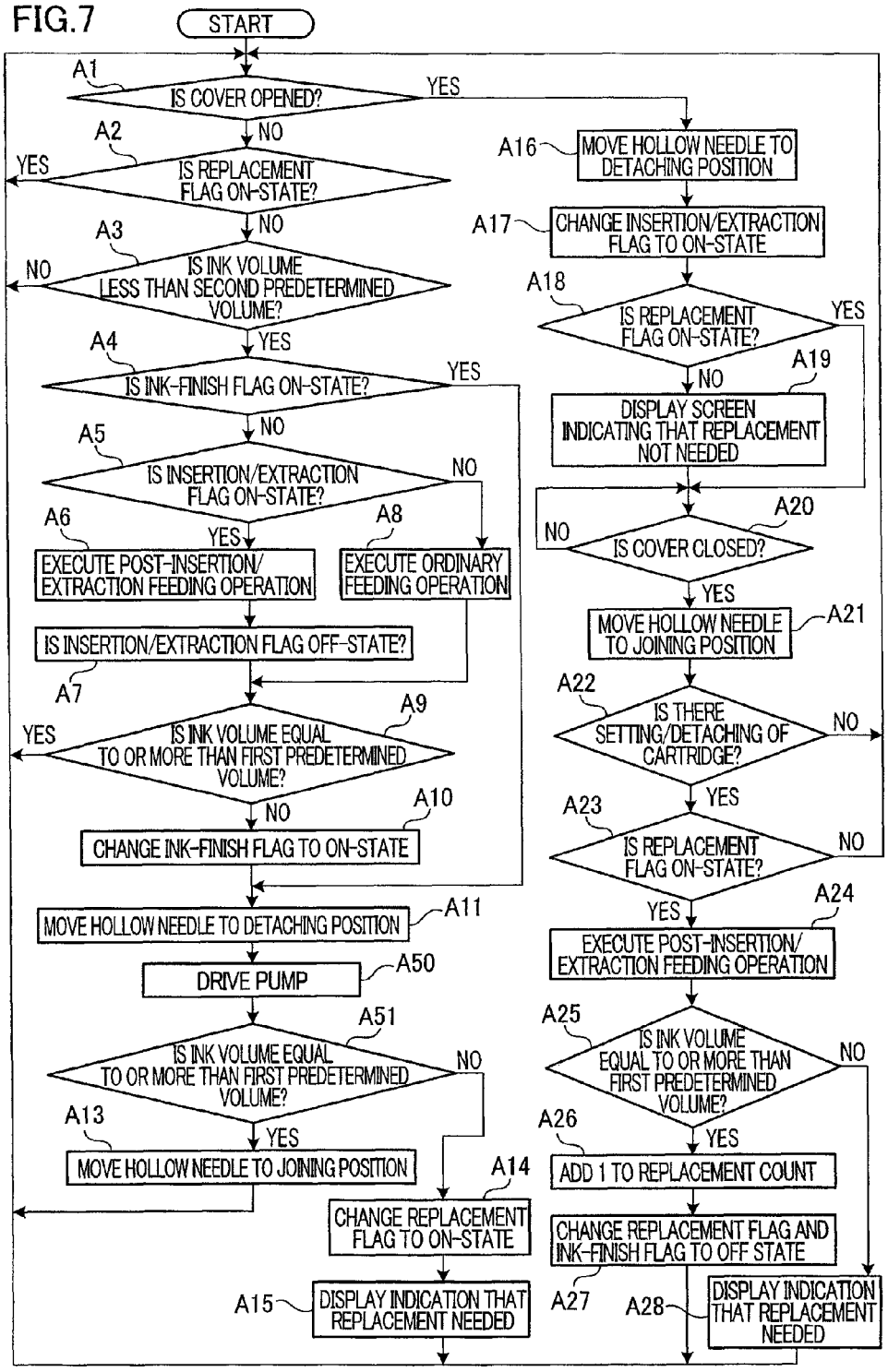
FIG. 7 is an operation flowchart of a control device of a liquid supplying apparatus related to a second embodiment.

Next, the following describes a liquid supplying apparatus 30 related to a second embodiment, with reference to FIG. 7. The second embodiment is different from the first embodiment in the structure of causing the ink in the liquid passage 81*a* to flow into the sub tank 70. In the present embodiment, when the first liquid volume determiner 121 determines that the ink volume in the buffer chamber 71 is less than the first predetermined volume despite the above described ink feeding operation performed by the liquid feed controller 123, the pump 83 is driven while the hollow needle 153 is disposed in the detaching position. In the following, the members that are identical to those of the above-mentioned first embodiment are given the same reference numerals and further description of these members are omitted as needed hereinbelow.

The second embodiment executes A50, A51 in place of A12 in the first embodiment, as shown in FIG. 7. Specifically, after A11, the replacement timing determiner 127 causes the liquid feed controller 123 to drive the pump 83 for an introduction feeding period so as to increase the ink volume in the buffer chamber 71 up to the first predetermined volume or more (A50). In short, the pump 83 is driven while the hollow needle 153 is detached from the cartridge 40. This way, the ink in the liquid passage 81*a* of the first supplying tube 81 flows into the buffer chamber 71 of the sub tank 70 due to the feeding force by the pump 83, in addition to its own weight.

After A50, the replacement timing determiner 127 determines whether or not the first liquid volume determiner 121 determines that the ink volume in the buffer chamber 71 is equal to or more than the first predetermined volume (A51). When the first liquid volume determiner 121 determines that the ink volume is equal to or more than the first predetermined volume (A51: YES), the replacement timing determiner 127 determines that the replacement time of the cartridge 40 has not yet come, and the process moves to A13. On the other hand, when the first liquid volume determiner 121 determines that the ink volume is less than the first predetermined volume (A51: NO), it is determined that the replacement time of the cartridge 40 has come, and the process moves to A14.

As hereinabove described, when the replacement timing determiner 127 determines that the replacement time of the cartridge 40 has come, the present embodiment more reliably reduce the ink remaining in the liquid passage 81*a* in A51, as compared with the first embodiment in which the ink in the liquid passage 81*a* flows into the sub tank 70 due to its own weight. Therefore, even when the cartridge 40 in the ink-finished state is mistakenly set to the tank receiving portion 60 at the time of replacing the cartridge 40, the ink volume in the sub tank 70 further unlikely be equal to or more than the first predetermined volume.

Third Embodiment

Figure 8:
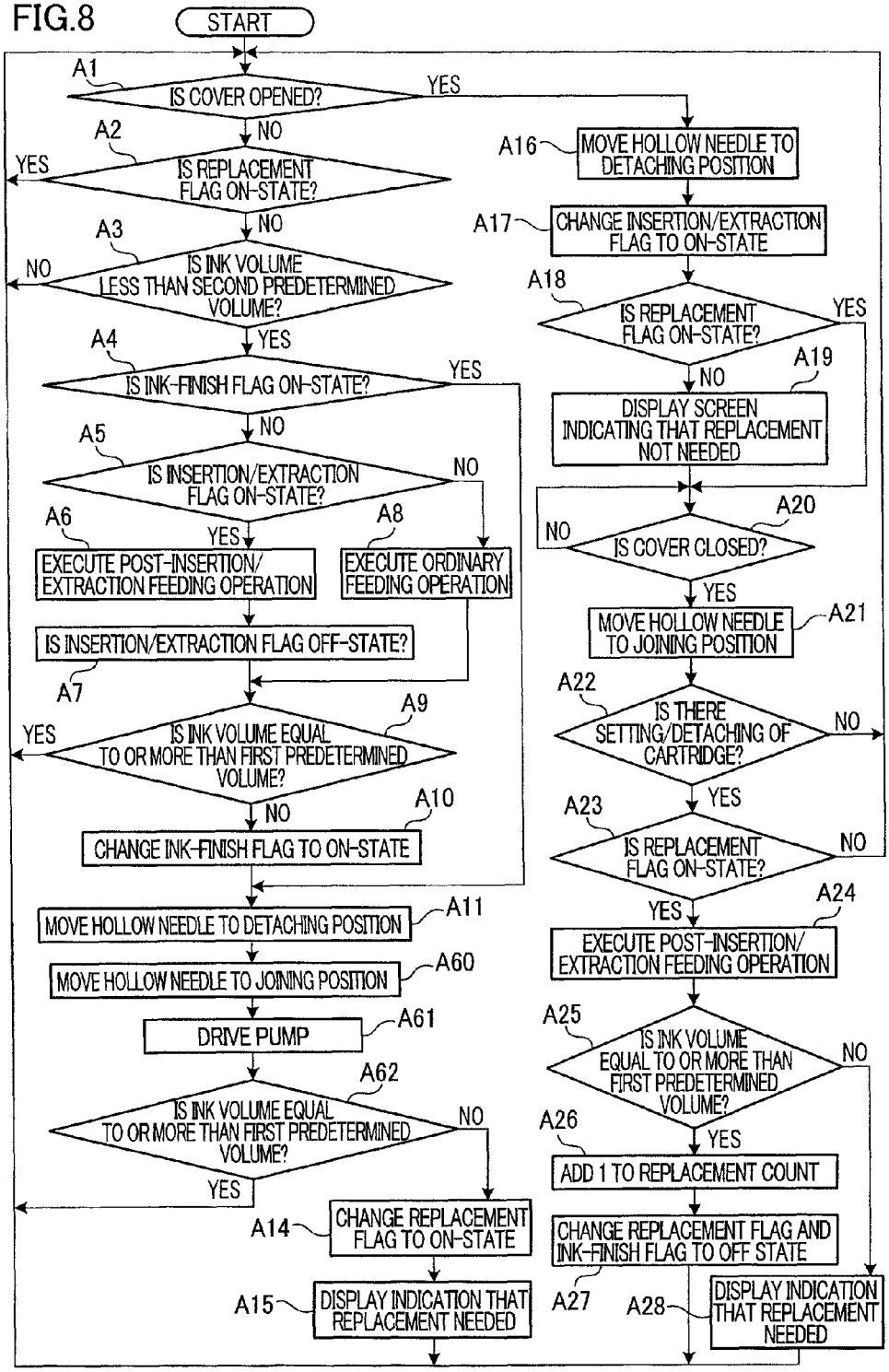
FIG. 8 is an operation flowchart of a control device of a liquid supplying apparatus related to a third embodiment.

Next, the following describes a liquid supplying apparatus 30 related to a third embodiment of the present invention, with reference to FIG. 8. The third embodiment is different from the first embodiment in that the structure of causing the ink in the liquid passage 81*a* to flow into the sub tank 70. In the present embodiment, when the first liquid volume determiner 121 determines that the ink volume in the buffer chamber 71 is less than the first predetermined volume despite the above described ink feeding operation performed by the liquid feed controller 123, the hollow needle 153 is moved to the joining position after elapse of a predetermined period after the hollow needle 153 is moved to the detaching position, and the pump 83 is driven in this state. In the following, the members that are identical to those of the above-mentioned first embodiment are given the same reference numerals and further description of these members are omitted as needed hereinbelow.

The third embodiment executes A60 to A62 in place of A12 and A13 in the first embodiment, as shown in FIG. 8. Specifically, in A60, the replacement timing determiner 127 causes the hollow needle movement controller 124 to operate the moving mechanism 155 so that the hollow needle 153 moves from the detaching position to the joining position, after a predetermined period elapses from the start of operation of the moving mechanism 155 in A10. Next, the replacement timing determiner 127 causes the liquid feed controller 123 to drive the pump 83 for an introduction feeding period so as to increase the ink volume stored in the buffer chamber 71 up to the first predetermined volume or more (A61). In short, the pump 83 is driven while the hollow needle 153 is joined with the cartridge 40. This way, even in cases where a volume of ink equivalent to the air introduced into the liquid passage 81*a* does not flow into the sub tank 70 due to the surface tension of the ink or the like, the feeding force by the pump 83 facilitates that volume of ink to reliably flow into the sub tank 70.

Next, the replacement timing determiner 127 determines whether or not the first liquid volume determiner 121 determines that the ink volume in the buffer chamber 71 is equal to or more than the first predetermined volume (A62). When the first liquid volume determiner 121 determines that the ink volume is equal to or more than the first predetermined volume (A62: YES), the replacement timing determiner 127 determines that the replacement time of the cartridge 40 has not yet come, and the process returns to A1. On the other hand, when the first liquid volume determiner 121 determines that the ink volume is less than the first predetermined volume (A62: NO), the replacement timing determiner 127 determines that the replacement time of the cartridge 40 has come, and the process moves to A14.

As hereinabove described, when the replacement timing determiner 127 determines that the replacement time of the cartridge 40 has come, the present embodiment more reliably reduce the ink remaining in the liquid passage 81*a* in A62, as compared with the first embodiment in which the ink in the liquid passage 81*a* flows into the sub tank 70 due to its own weight. Therefore, even when the cartridge 40 in the ink-finished state is mistakenly set to the tank receiving portion 60 at the time of replacing the cartridge 40, the ink volume in the sub tank 70 further unlikely be equal to or more than the first predetermined volume.

Fourth Embodiment

Figure 9:
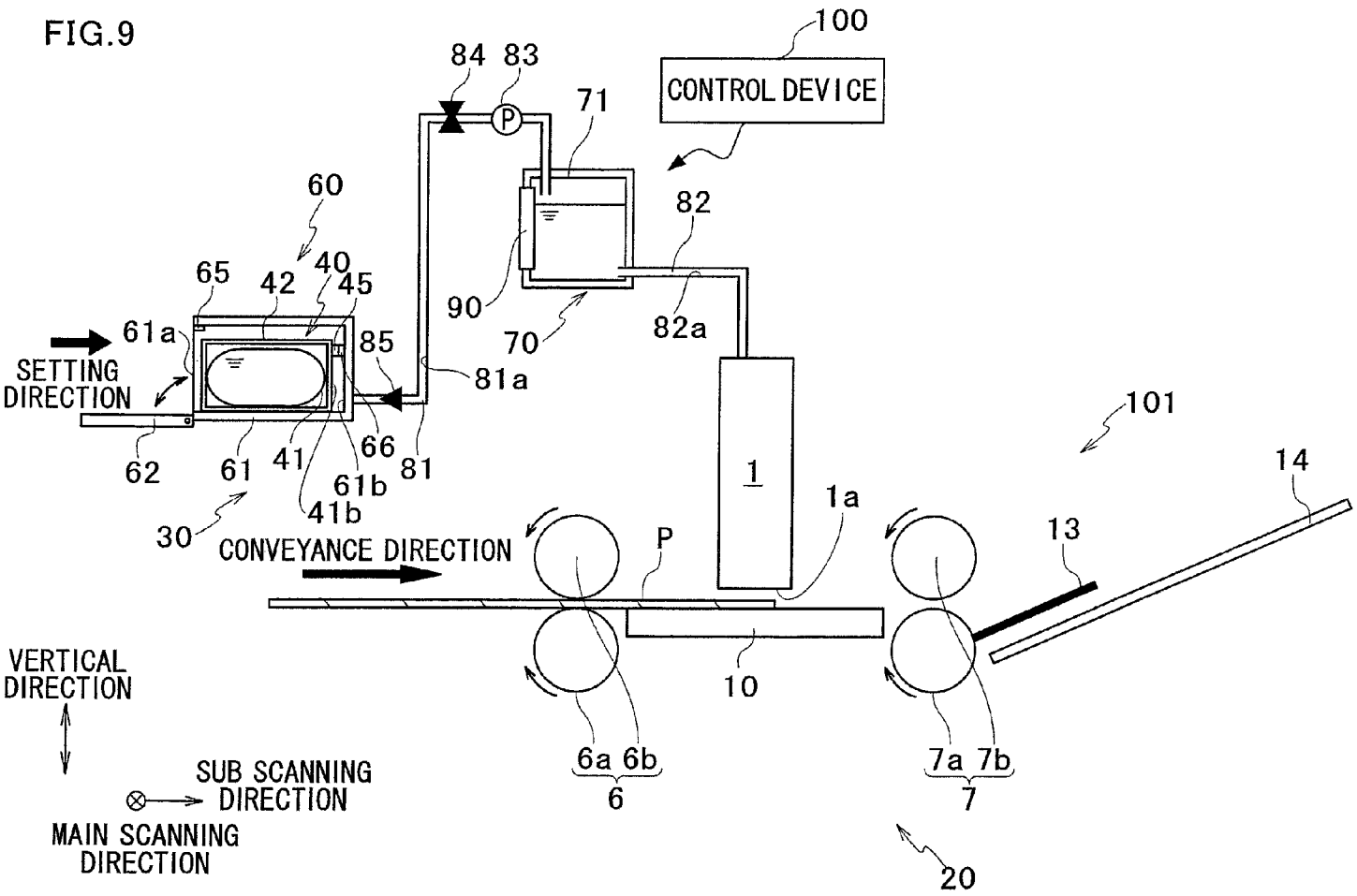
FIG. 9 is a schematic side view of an inkjet printer having a liquid supplying apparatus related to a fourth embodiment.

Next, the following describes a liquid supplying apparatus 30 related to a fourth embodiment of the present invention, with reference to FIG. 9. The fourth embodiment is different from the first embodiment in that the sub tank 70 is disposed in a position higher than the position of the tank receiving portion 60 relative to the vertical direction. Further, nearby the end portion of the hollow needle 153 of the first supplying tube 81 is provided a check valve 85. In the present embodiment, the check valve 85 corresponds to the anti-back flow mechanism.

The check valve 85, while allowing the flow of ink from the hollow needle 153 to the buffer chamber 71, prevents a flow of ink from the buffer chamber 71 to the hollow needle 153. This way, the ink in the liquid passage 81*a* does not leak from the hollow needle 153, even if the hollow needle 153 is detached from the cartridge 40.

Further, in the present embodiment, the sub tank 70 is disposed in a position higher than the position of the tank receiving portion 60 relative to the vertical direction. Therefore, even if the air is introduced into the liquid passage 81*a*, the ink in the liquid passage 81*a* does not flow into the buffer chamber 71 of the sub tank 70, due to its own weight. In view of this, in the present embodiment, the pump 83 is driven so as to cause the ink in the liquid passage 81*a* flow into the sub tank 70. Note that, as an operation flow of the liquid supplying apparatus 30 of the fourth embodiment, either one of the operation flow of the above described second embodiment (see FIG. 7) and the operation flow of the above-described third embodiment (see FIG. 8) is adoptable. In other words, as in the second embodiment, it is possible to drive the pump 83 while the hollow needle 153 is disposed in the detaching position so as to cause the ink in the liquid passage 81*a* to flow into the sub tank 70 due to the feeding force by the pump 83. Alternatively, as in the third embodiment, it is possible to drive the pump 83 while the hollow needle 153 is disposed in the joining position so as to cause the ink in the liquid passage 81*a* to flow into the sub tank 70 due to the feeding force by the pump 83.

With the above-describe present embodiment, the ink in the liquid passage 81*a* is fed to the sub tank 70 by driving the pump 83, even when the sub tank 70 is disposed in a position higher than the position of the tank receiving portion 60 relative to the vertical direction.

Note that the above described four embodiments deal with a case where the hollow needle 153 (supporting medium 154) is moved relative to the tank receiving portion 60 by the moving mechanism 155 so as to join/detach the hollow needle 153 with/from the cartridge 40; however, the hollow needle 153 (supporting medium 154) may be fixed and the tank receiving portion 60 having the cartridge 40 set thereto may be moved to join/detach the cartridge 40 with/from the hollow needle 153.

Further, the above described four embodiments deal with a case where the valve 84 is provided to the first supplying tube 81; however the valve 84 does not have to be provided. Further, when the valve 84 is not a type of valve that completely shuts the liquid passage 81*a* of the first supplying tube 81, the introduction of the air into the liquid passage 81*a* by detaching the cartridge 40 from the hollow needle 153 becomes remarkable.

Further, in the above described four embodiments, introduction of the air into the liquid passage 81*a* of the first supplying tube 81 is done by detaching the cartridge 40 from the hollow needle 153. However, a different method is also adoptable. For example, an air introduction port in communication with the external air is formed nearby an end portion of the first supplying tube 81 on the side of the hollow needle 153, and an open/close mechanism that opens and closes the air introduction port is provided. With this structure, the open/close mechanism may open the air introduction port only when the air is introduced into the liquid passage 81*a*.

Further, in the above described four embodiments, the post-insertion/extraction feeding operation by the liquid feed controller 123 is the same irrespective of the number of times the hollow needle 153 is inserted into or extracted from the plug 51 and the detached period during which the hollow needle 153 is detached from the cartridge 40 from the immediately previous feeding operation. However, the operation may be varied depending on the number of times the hollow needle 153 is inserted into or extracted from the plug 51 and the detached period. For example, with an increase in the number of times the hollow needle 153 is inserted/extracted, the ink volume in the liquid passage 81*a* is reduced. Therefore, the feeding period for driving the pump 83 may be made longer. Similarly, with an increase in the detached period, the ink volume in the liquid passage 81*a* is decreased. Therefore, the feeding period for driving the pump 83 may be made longer.

Further, the above-described first embodiment may be adapted so that the first supplying tube 81 may be provided with a check valve which allows a flow of the ink from the hollow needle 153 to the buffer chamber 71 while preventing a flow of the ink from the buffer chamber 71 to the hollow needle 153, as in the fourth embodiment. Further, in the above-described fourth embodiment, the check valve 85 structures the anti-back flow mechanism preventing the leakage of the ink in the liquid passage 81*a* from the hollow needle 153; however, the present invention is not limited to this. For example, the pump 83 may have a function of the anti-back flow mechanism.

Further, in the above described four embodiments, the touch panel 95 structures a notification unit for indicating the replacement time of the cartridge 40; however, the present invention is not limited to this. For example, the notification unit may be a speaker or the like that indicates the replacement time to the user by an audio output.

Further, the in the above-described embodiment, only one CPU structures the control device 100. However, the control device 100 may be structured by a plurality of CPUs, ASIC (Application Specific Integrated Circuit), or a combination of a CPU and a specific ASIC.

The present invention is also applicable to any liquid supplying apparatus supplying a liquid other than the ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid supplying apparatus, comprising:

a tank receiving portion configured to receive a main tank, the main tank comprising a first reservoir configured to store a liquid in such a manner as to seal off the surrounding space and configured to shrink as the liquid is fed to the outside of the first reservoir;

a sub tank disposed in a position lower than a position of the tank receiving portion, which comprises a second reservoir configured to store the liquid supplied from the first reservoir of the main tank set to the tank receiving portion;

a liquid passage configured to communicate the first reservoir of the main tank set to the tank receiving portion with the second reservoir, whose one end portion on the side to be in communication with the first reservoir is configured to be joined with or detached from the main tank;

a mover configured to move the tank receiving portion and the end portion of the liquid passage relatively to each other so as to join or detach the end portion of the liquid passage with or from the main tank set to the tank receiving portion;

a liquid feeder configured to feed the liquid stored in the first reservoir of the main tank set to the tank receiving portion to the second reservoir through the liquid passage;

a sensor disposed at the sub tank and configured to output a signal related to a level of liquid in the second reservoir; and a controller configured to:

(a) control the mover and the liquid feeder;

(b) determine whether a liquid volume in the second reservoir is less than a second predetermined volume which is less than a first predetermined volume;

(c) operate the liquid feeder so as to feed the liquid stored in the first reservoir of the main tank set to the tank receiving portion to the second reservoir, when the controller determines that the liquid volume in the second reservoir is less than the second predetermined volume, in order to increase the liquid volume in the second reservoir up to the first predetermined volume or more;

(d) determine whether the liquid volume in the second reservoir is equal to or more than the first predetermined volume based on the signal of the sensor after the operation of (c);

(e) operate the mover so as to detach the end portion of the liquid passage from the main tank set to the tank receiving portion when the controller determines that the liquid volume in the second reservoir is less than the first predetermined volume; and (f) determine whether the liquid volume in the second reservoir is equal to or more than the first predetermined volume based on the signal of the sensor after the operation of (e).

2. The liquid supplying apparatus according to claim 1, wherein, in the step (f) the controller is configured to:

determine whether the liquid volume in the second reservoir is equal to or more than the first predetermined volume after a predetermined period elapses from the start of the operation of (e).

3. The liquid supplying apparatus according to claim 1, further comprising a storage configured to store a replacement count of the main tank, wherein, when the controller determines that the liquid volume in the second reservoir equals to or more than the first predetermined volume after determining that the liquid volume in the second reservoir is less than the first predetermined volume in the determination of (f), the control unit adds 1 to the replacement count of the main tank in the storage.

4. The liquid supplying apparatus according to claim 1, further comprising a notification unit configured to notify that a replacement time of the main tank has come, when the control unit determines that the liquid volume in the second reservoir is less than the first predetermined volume in the determination of (f).

5. The liquid supplying apparatus according to claim 1, wherein when the main tank is newly set to the tank receiving portion after determining that the liquid volume in the second reservoir is less than the first predetermined volume in the determination of (f), the controller is configured to operate the liquid feeder for a feeding period which is longer than the a feeding period in the operation of (c) so as to feed the liquid stored in the first reservoir of the main tank receiving portion to the second reservoir, in order to increase the liquid volume in the second reservoir up to the first predetermined volume or more.

6. The liquid supplying apparatus according to claim 1, wherein the controller is configured to operate the mover so as to join the end portion of the liquid passage with the main tank set to the tank receiving portion when the control unit determines that the liquid volume in the second reservoir is equal to or more than the first predetermined volume in the determination of (f).

7. The liquid supplying apparatus according to claim 1, wherein the controller is configured to:

(g) operate the liquid feeder to feed the liquid in the liquid passage to the second reservoir, in order to increase the liquid volume in the second reservoir up to the first predetermined volume or more between the operation of (e) and the determination of (f).

8. The liquid supplying apparatus according to claim 7, wherein, in the step (g), the controller is configured to:

operate the liquid feeder to feed the liquid in the liquid passage to the second reservoir, in order to increase the liquid volume in the second reservoir up to the first predetermined volume or more between the operation of (e) and the determination of (f) while the end portion of the liquid passage is detached from the main tank set to the tank receiving portion.

9. The liquid supplying apparatus according to claim 7, wherein the controller is configured to:

(h) operate the mover so as to join the end portion of the liquid passage with the main tank set to the tank receiving portion between the operation of (e) and the operation of (g), and in the step (g) operate the liquid feeder to feed the liquid stored in the liquid passage to the second reservoir, in order to increase the liquid volume in the second reservoir up to the first predetermined volume or more between the operation of (e) and the determination of (f) while the end portion of the liquid passage is joined with the main tank set to the tank receiving portion.

10. A method of controlling a liquid supplying apparatus including:

a tank receiving portion configured to receive a main tank, the main tank comprising a first reservoir configured to store a liquid in such a manner as to seal off the surrounding space and configured to shrink as the liquid is fed to the outside of the first reservoir;

a sub tank disposed in a position lower than a position of the tank receiving portion, which comprises a second reservoir configured to store the liquid supplied from the first reservoir of the main tank set to the tank receiving portion;

a liquid passage configured to communicate the first reservoir of the main tank set to the tank receiving portion with the second reservoir, whose one end portion on the side to be in communication with the first reservoir is configured to be joined with or detached from the main tank;

a mover configured to move the tank receiving portion and the end portion of the liquid passage relatively to each other so as to join or detach the end portion of the liquid passage with or from the main tank set to the tank receiving portion;

a liquid feeder configured to feed the liquid stored in the first reservoir of the main tank set to the tank receiving portion to the second reservoir through the liquid passage; and a sensor disposed at the sub tank and configured to output a signal related to a level of liquid in the second reservoir, the method comprising:

(a) controlling the mover and the liquid feeder;

(b) determining whether a liquid volume in the second reservoir is less than a second predetermined volume which is less than a first predetermined volume;

(c) operating the liquid feeder so as to feed the liquid stored in the first reservoir of the main tank set to the tank receiving portion to the second reservoir, when the controller determines that the liquid volume in the second reservoir is less than the second predetermined volume, in order to increase the liquid volume in the second reservoir up to the first predetermined volume or more;

(d) determining whether the liquid volume in the second reservoir is equal to or more than the first predetermined volume based on the signal of the sensor after the operation of (c);

(e) operating the mover so as to detach the end portion of the liquid passage from the main tank set to the tank receiving portion when the controller determines that the liquid volume in the second reservoir is less than the first predetermined volume; and (f) determining whether the liquid volume in the second reservoir is equal to or more than the first predetermined volume based on the signal of the sensor after the operation of (e).

* * * * *